US008328053B2

(12) United States Patent
Bargo

(10) Patent No.: US 8,328,053 B2
(45) Date of Patent: Dec. 11, 2012

(54) SIPHON HEAD

(75) Inventor: Esteban Eduardo Bargo, Buenos Aires (AR)

(73) Assignee: Parrit S.A., Buenos Aires (AR)

( * ) Notice: Subject to any disclaimer, the term of this patent is extended or adjusted under 35 U.S.C. 154(b) by 569 days.

(21) Appl. No.: 11/493,975

(22) Filed: Jul. 27, 2006

(65) Prior Publication Data

US 2007/0023458 A1 Feb. 1, 2007

(30) Foreign Application Priority Data

Jul. 27, 2005 (AR) ..... P20050103127

(51) Int. Cl.
*B65D 83/00* (2006.01)

(52) U.S. Cl. ..... 222/402.25; 222/153.05; 222/514; 222/518; 215/4

(58) Field of Classification Search ..... 215/4, 5; 137/863; 251/336; 222/513, 514, 153.05, 222/511, 402.25, 518
See application file for complete search history.

(56) References Cited

U.S. PATENT DOCUMENTS 710,674 A * 10/1902 Fassmann ..... 215/5
2,372,392 A * 3/1945 Pletman ..... 222/402.25
2,539,929 A * 1/1951 Roberts ..... 222/394
2,678,747 A * 5/1954 Caitung ..... 215/5
2,830,745 A * 4/1958 Aicart ..... 222/323
3,317,092 A * 5/1967 Jurasek ..... 222/402.13
3,324,903 A * 6/1967 Hinz ..... 215/4
3,351,415 A * 11/1967 Hoffman ..... 401/137
3,415,426 A * 12/1968 Kleveland ..... 222/402.11
4,617,973 A * 10/1986 Hagan et al. ..... 141/2
4,660,748 A * 4/1987 Hagan ..... 222/509
4,671,436 A * 6/1987 Hagan ..... 222/402.25
4,694,975 A * 9/1987 Hagan ..... 215/4
4,773,571 A * 9/1988 Hagan et al. ..... 222/394
4,860,932 A * 8/1989 Nagy ..... 222/402.1
5,046,645 A * 9/1991 Hagan et al. ..... 222/394
5,588,562 A * 12/1996 Sander et al. ..... 222/153.06

* cited by examiner

*Primary Examiner* — Kevin P Shaver
*Assistant Examiner* — Daniel R Shearer
(74) *Attorney, Agent, or Firm* — Edwards Wildman Palmer LLP

(57) ABSTRACT

The invention relates to a siphon head formed by three basic components constituted by a first part comprised by an interchangeable actuator head, a second part comprised by the safety closure of the container and a third part comprised by the valve system permitting dispensing the fluid contained into the bottle including a resilient material part constituted by a head joined to elastic memory members.

14 Claims, 4 Drawing Sheets

SIPHON HEAD

FIELD OF THE INVENTION

The instant invention relates to closing heads and actuators for bottles containing gasified liquids (soft drinks) which include dispensing valve means. Among these containers, there are those dispensing soft drinks and also those conventionally known as siphons. More particularly, the invention relates to a head formed by three basic components: a first part comprised by an interchangeable actuator head, a second part comprised by the safety closure of the container and a third part comprised by the valve system permitting dispensing the fluid contained into the bottle. The second and third parts may be joined together to provide an integrated cap assembly that threads onto the mutually threaded neck of a beverage container.

BACKGROUND

The main object of the invention is a novel and efficient structure, of the kind represented by a valve means included within the mentioned head fixed by means of threads in the container neck which, apart from constituting the tight seal thereof, provides an actuator member acting on the valve means for dispensing the contents via the internal pressure, affording the particular feature that the actuating head is comprised by a device selected among different arrangements, thus being interchangeable.

A further object of the invention is an optimized siphon head in which the second of its component parts comprises an efficient safety closure for the container containing a pressurized soft drink, with the particularity that the third component part of the valve means is mounted on the structure thereof, such that by mounting the first component part on said safety closure, an interchangeable actuating means is provided, with which the soft drink is dispensed through an ejecting element, directly operating with said interchangeable means on said integral valve means.

Consequently, the object of the instant invention is a head to be particularly applied to containers known as siphons, threaded as a closure for the container which is filled with a pressurized soft drink of any of the existing types, including the popular siphons containing soda water. These particular containers are provided with a nozzle for dispensing the drink in reply to the actuating means operating on the plugging valve element wherein the part joining all these elements forming a single head has been improved, being replaced by independent assemblies from which one is the actuating means, provided in some cases with an actuating lever and a dispensing nozzle, the second assembly is comprised by the plugging means tightly joined to the container, the third being the valve member which, once actuated, allows dispensing the contents of the bottle into which it is stored under pressure. Therefore the invention comprises, with one of its component parts, a double purpose closure means, constituted by a symmetric rotating body excellent for an easy manufacture, whose features, apart from being removable by means of threads, is capable of incorporating different actuating means, completely independent from the valve system, which constitute a constructive alternative of the head of the invention which is the incorporation of said actuating means with the dispensing nozzle in its structure, the operative portion of the head being an additional interchangeable member.

Another advantage of the siphon head of the invention is the simplification of the operating processes used at present in the filling plant, which are optimized due to the development of a revolution body for forming the closure and plugging core of the discharge conduit of the pressurized fluid within the container, also optimizing the daily activity carried out for the previous threading of the plugging body including the valve on the container, filling at the plant with the pressurized drink and further handling during storing and delivery of the product.

PRIOR ART

Several embodiments of water soda siphons are used at present. Originally the siphon is comprised by a reinforced glass container, plugged at the mouth by a closure and an actuating body formed such that it has a tubular nozzle for dispensing the drink with an angled downwardly inclined nozzle and an arched lever, linked to an upper boss.

The closure and operating body houses a valve means, which is displaceable by means of the lever action, thus dispensing the gasified water under pressure, through a central glass tube extending to the bottom of the container.

The mouth of the container has an annular flange on which an annular diametrically divided piece having a thread by means of which the head is supported is fitted.

This kind of container, still used at present, was subject to several modifications from the addition of a reticular metal body, used as a shield against eventual explosions of the container, which took place relatively often, to completely metallic containers with an additional valve member allowing the user filling the bottle with water and then feeding the carbon gas contained in an additional container which may be threaded. Afterwards, containers completely made of plastics appeared, and also modifications in the actuating means provided in the operative body.

Some of the above embodiments has a cylindrical shape to be fitted inside the container mouth, housing the valve means, operated by means of an outer actuating mechanism.

Among prior art references, the following may be cited:

Argentine application P030102139 directed to "A metering valve for an aerosol container". It comprises a cap and a valve housing into an inner cavity, wherein a compression spring is included having a valve joint closing said inner cavity, and a compressible seal member against the dispensing conduit closed by the valve joint. A lower surface of the annular flange with compressible sealing members and the annular edge form a seal therebetween dividing the lower cavity into a metering chamber and a separated filling chamber, permitting that only the product in the metering chamber be dispensed once a flow line for the product is established.

The above embodiment was specially designed for metering the contents of a container. These features do not interfere with the object of the invention, since, among other differences, it is fixed by a peripheral permanent flange which cannot be removed.

Industrial M. No. 62728 (Lebon, J. E.) "Dispensing head for soft drink containers". The faceted head is a hollow polygonal body. The actuating means is a push button having access from the upper part with a determined arrangement.

Argentine patent No. 251,443 (Lebon, J. E.) "Valve for liquids under gas pressure". The body is formed by mutually joined parts. An upper part, the cover being plugged at the upper part by a resilient membrane forming the push button, which is extended by a rod actuating the valve. An intermediate part, which is threaded to the container, providing the dispensing nozzle and a central portion on which the valve is seated and an inner part carrying a conical valve.

Argentine patent No. 250,291 (Roberto José Pitocco), Jan. 28, 2003 "Improvements in valve heads for dispensing water soda in siphons claims a valve body with a central open channel, communicated with the nozzle forming the valve seat, the rod of which crosses the central channel and is connected with a resilient membrane, shaped as a vaulted cap the edges of which seat against the valve body forming the upper seal. Above the cap there is the actuating lever bearing on an bore of a removable cap and exiting through an opposite bore, the lever being a second genus lever.

Argentine application P97 01 05091, Oct. 31, 1997 (R. J. Pitocco) "Improvements in valve dispensing heads, connectable to soft drinks bottles and other uses". The actuating lever is foldable. It has a safety strap finishing the head. It comprises a valve system similar to that of patent 250,291. The lever formed by two foldable parts is linked and joined to the valve rod in the same way and has resilient elongated means. A double arched filament is shown positioned between a lever point near to the bearing point and an opposed point on the inner transversal wall. The body is threaded onto the bottle with a safety strap as a conventional ring.

Argentine application M98 01 02559, Jan. 21, 1998 (SIDES S. A.) "Improvements in valve heads for soft drink bottles and other uses". This is a simplification of P97 01 05091. It has the same resilient means. The articulated lever forms part of the upper part of the head released by the strap, integrating the covering cap which is mounted on the body carrying the valve and the dispensing nozzle.

The above references are based on the articulated lever, retainers and closure valve alternatives. They comprise actuating caps with their lever and rod and a valve means including the dispensing nozzle fixed to the container.

As mentioned, the above references do not anticipate the object of the invention.

SUMMARY OF THE INVENTION

The object of the present invention is a SIPHON HEAD comprised by three parts. The first part is the interchangeable operative head for actuating the valve means, which may selected from the most appropriate arrangements in the art. The first part is fixed to the second part, i.e. the intermediate part, which provides means for fixing the first part and provides structural alternatives for forming the third part. The second and third parts may be joined together to provide a cap assembly (comprising an integrated safety closure and valve system) that threads onto the mutually threaded neck of a beverage.

The second part has at the center of its transversal partition an bore flanked at the outside by an annular channel, the bore being interiorly provided with seat means for the valve constituting the third part, which is housed within a tubular interiorly threaded enclosure, formed in this intermediate part, coaxially positioned with respect to said bore. An embodiment of the invention contemplates that about at half height inside said tubular enclosure there are provided, annularly, means for retaining the valve. The third valve part is comprised by a body formed by a head with elastic memory forming the valve and retaining the fishing tube.

BRIEF DESCRIPTION OF THE DRAWINGS

In the above figures the same reference symbols designate the same or corresponding parts.

DETAILED DESCRIPTION OF THE INVENTION

Figure 1:
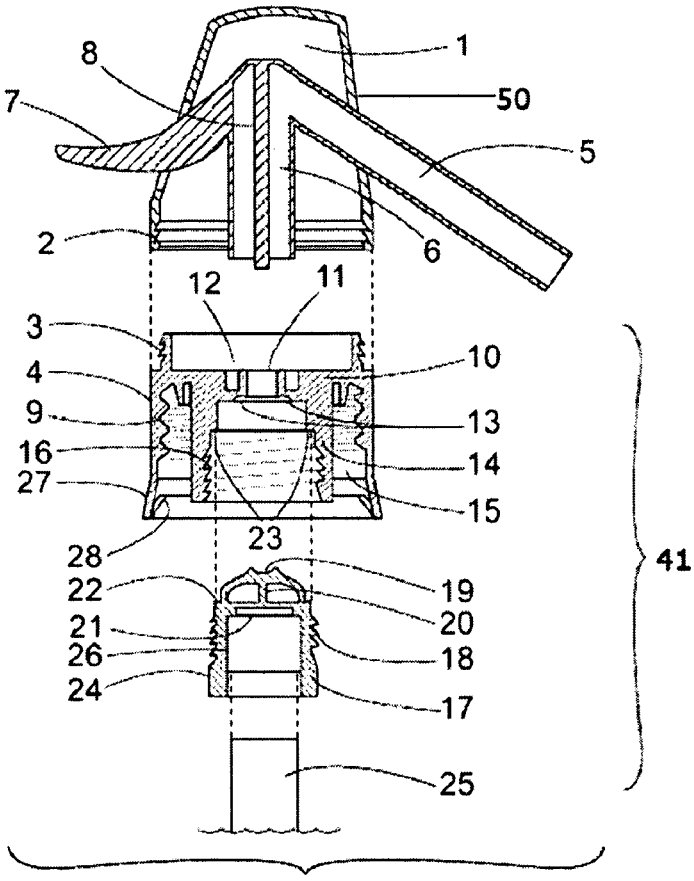
FIG. 1 is a longitudinal cross section exploded view of a siphon head according to a preferred embodiment of the invention.
Figure 2:
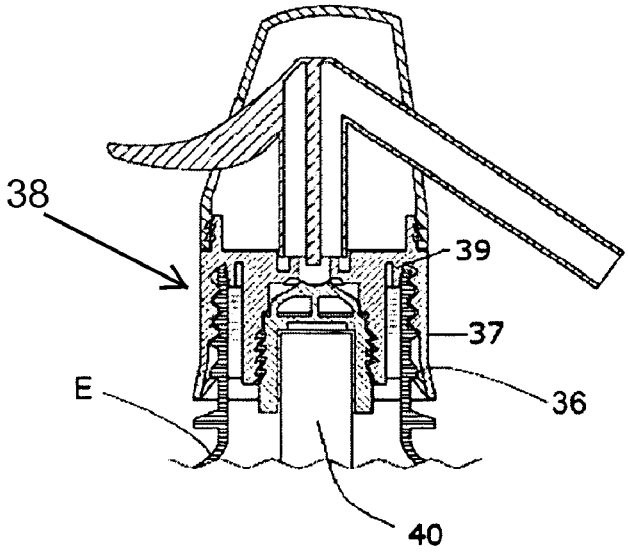
FIG. 2 is longitudinal cross section of the siphon head of FIG. 1, mounted in the neck of a container having a pressurized beverage.
Figure 3:
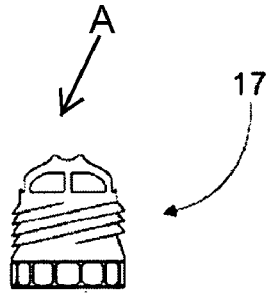
FIG. 3 is a side elevation view of a resilient valve piece according to a preferred embodiment of the invention.

As shown in FIGS. 1 to 3, the first part of the head is comprised by the actuator body 1 having a housing 50, provided with serrated fitting fillets 2 which interact with equivalent fillets 3 in the second part 4 used for the safety plugging of the container E. It is provided with ejector nozzle 5, prolongation of a vertical tubular portion 6, and with the actuating lever 7 linked to the axial rod 8 pushing the valve means.

The second part 4, having a main body in the form of a cylindrical shell 38, is provided with inner thread 9 intended to interact with the thread at the mouth of container E. At the transversal partition 10 forming part of the hollow cylindrical body of the second part of the head, there is an axial bore 11 flanked by an annular channel 12. Shell 38 further comprises an annular ring 39 concentric with and interior to said threads 9 in said shell for forming a fluid-tight seal with the inner upper circumference of said threaded neck 37 of said container E.

The bore 11 is surrounded, at the outlet, by an annular rib ending as a point 13, as component part of a first seal, which is directed towards the interior of the cover ending coaxially into a cylindrical enclosure (or "boss") 14 partially occupying the larger portion of the inner space 15 of second part 4. Said cylindrical enclosure 14 is interiorly provided with a thread fillet 16 where the valve means 17 is threaded by means of fillets 18 provided on its body. When so fitted, valve 17 (and as will be discussed siphon tube 25) will, together with second part 4, form integrated cap assembly 41.

The third part of the head is the valve means comprised by a piece 17 of resilient material complying with sanitary standards. It has a half sphere shaped head having its plugging seat 19 at the top, formed with a semicircular central depression limited by the elevated flange, this portion being partially introduced into bore 11 thus forming the first tight seal. In an analogous way, it follows a hollow cap, with radial 90° crossed ribs, 20, (which function as a spring for resetting the closure of seat 19 against tapered annular rib 13 when operation of the valve finishes) and an inner disk member 21 provided with a sharp shoulder 22 adjacent its contour edge, which functionally cooperates with a triangular fillet 23 projecting inside cylindrical closure 14. This arrangement constitutes a second seal means for avoiding eventual gas losses. The valve means ends with an outer faceted ring 24 as shown by A in the figure.

The resilient valve means is engaged by a snap fit at the upper end of conventional fishing (or "siphon") tube 25 extending to the bottom of the container and having an inner passage 40 therein for feeding liquid from said container. This joint is reinforced by grooves 26 provided inside the valve body 17.

The head may be completed in the second part 4 with an interlock in the form of annular skirt 27 inside which there are angularly arranged projecting retaining members 28 distributed annularly. This annular skirt is used to be fastened to mouth E of the container. It forms a safety strap which is cut when the cap assembly is unthreaded.

The second part 4 is fitted on the first part. Operative member 1 contains dispensing conduits formed by the nozzle of siphon 5 and vertical piece 6. Vertical piece 6 is adapted to tightly align with channel 12. Additionally, vertical piece six and siphon 5 are located apart from the articulated lever 7 that actuates the pusher rod 8.

Figure 4:
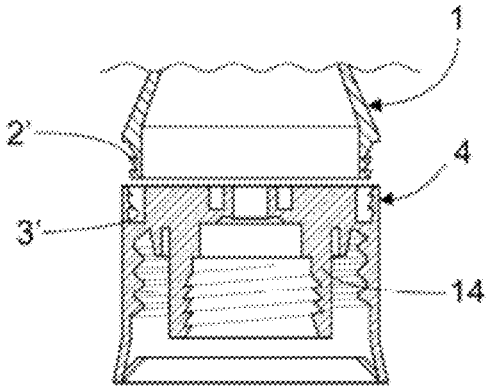
FIGS. 4 and 5 show partial cross section exploded views of two other alternatives of the invention.
Figure 5:
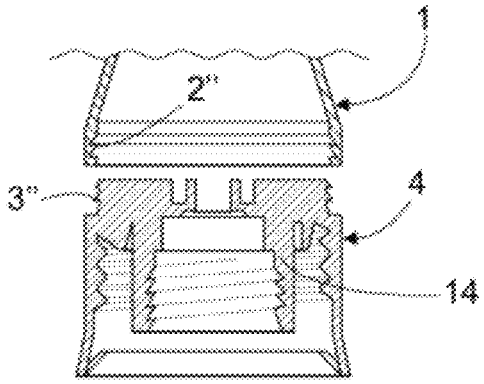
Figure 6:
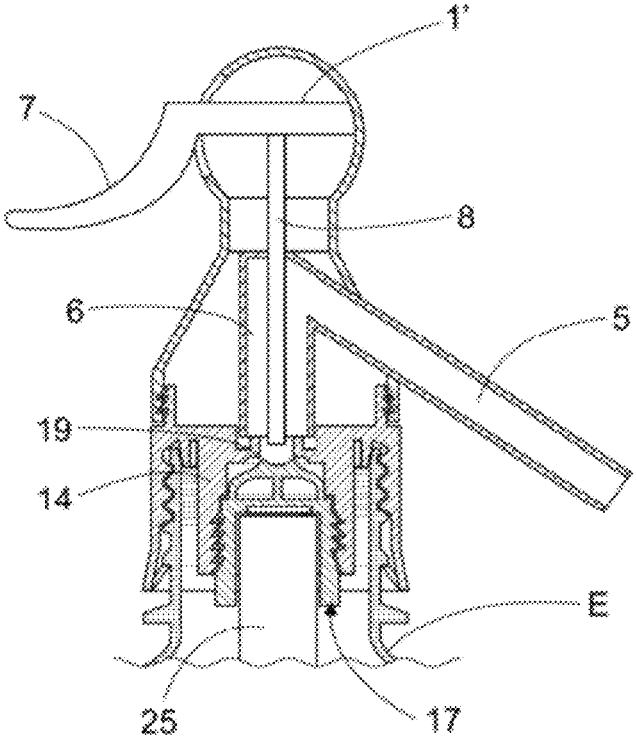
FIG. 6 is a longitudinal cross section view of a siphon head according to another embodiment of the invention.

FIGS. 4 and 5 show a pair of alternatives for locating the mutual fitting means 2, 3 for obtaining a firm engagement between the first 1 and second 4 parts forming the head.

The arrangement shown in FIGS. 1 to 3 correspond to an upper end fitting.

The arrangement shown in FIG. 4 corresponds to the same kind of fitting, this time as an inner fitting 2', 3', and that one of FIG. 5 is a side outer fitting 2", 3".

Figure 7:
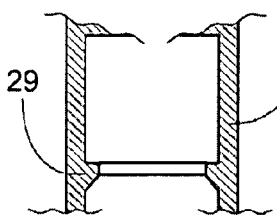
FIGS. 7 to 12 are partial cross section views of different embodiments of the coaxial cylindrical closure for mounting and retaining the resilient valve piece.
Figure 8:
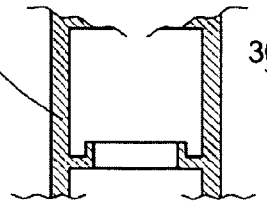
Figure 9:
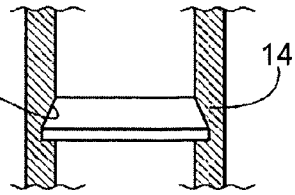
Figure 10:
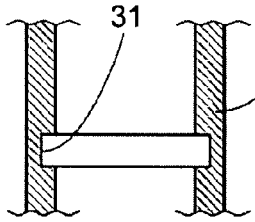
Figure 11:
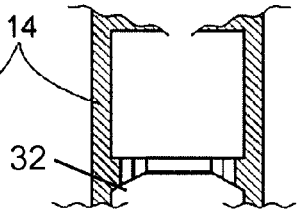
Figure 12:
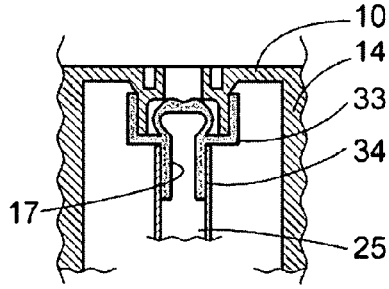

While the fastening means inside cylinder 14 of the second part 4 are attained, as shown in FIG. 7, by means of a diameter restriction constituted by an annular flange which as shown in FIG. 8 adds a small elevated peripheral flange to the annular restriction. In FIG. 9, it is constituted by a triangular channel 30, in FIG. 10 it is a square section channel 31. In FIG. 11 restriction of annular member is larger with increasing section, while in FIG. 12 all the valve member 17 is formed by a cylindrical body 33 threaded to cylindrical wall 14, modified with a smaller height and threaded at the outside. This body includes prolongation 34 as a support for the fishing tube 25.

FIGS. 13 to 21 shows different configurations of the closure elastomeric member with alternative resilient structures for the valve closure member 17. They have a head 19', which is substantially frustoconical and offer different arrangements for the complementary elastic memory member which also maintains such arrangements against the respective seat 13, in the direction of the internal pressure inside the container.

In the embodiments of FIGS. 13, 16, 18 and 22, the seat formed on partition 10 is frustoconical and its diameter decreases upwardly. In the embodiments of FIGS. 14, 15, 17, 19, 20, 21 and 23, the seat is a triangular fillet 13 surrounding bore 11 which forms the outlet conduit for the beverage stored into the container.

Figure 13:
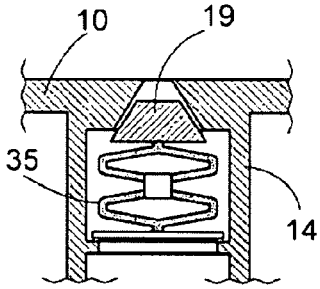
FIGS. 13 to 21 are partial cross section views of different embodiments of the coaxial cylindrical closure and resilient valve pieces.
Figure 14:
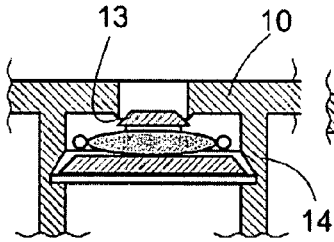
Figure 15:
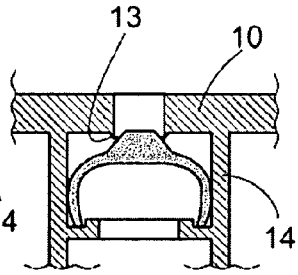
Figure 16:
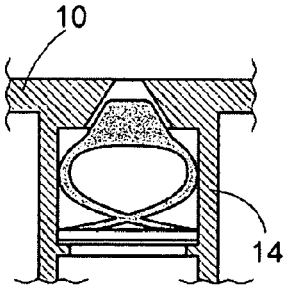
Figure 17:
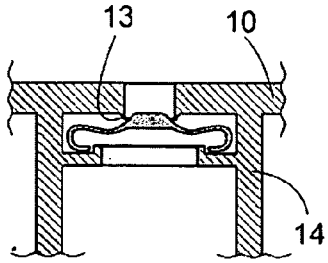
Figure 18:
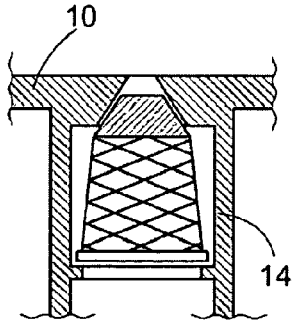
Figure 19:
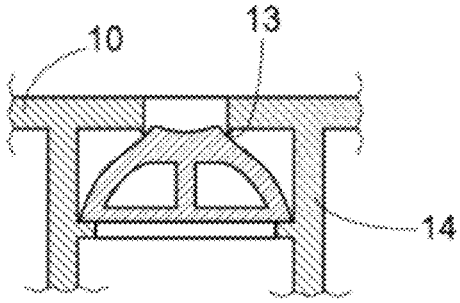

In FIG. 13, in the closure means 17, resilient means provided adopt a shape 35 such as polygonal bellows joined therebetween and having a bearing disk. In FIG. 14 they are lentil shaped, in FIG. 15 they have resilient arms, in FIG. 16 the cross, in FIG. 17 they are arched, reticulated as in FIG. 18, with a half-sphere shape in FIG. 19 and in FIG. 21 they are lobe shaped having the disk support as a peripheral wedge, and any other possible shape affording the optimum elastic reaction for maintaining the outlet conduit 11 tightly plugged in the direction of the internal pressure of the stored fluid mixture.

Figure 20:
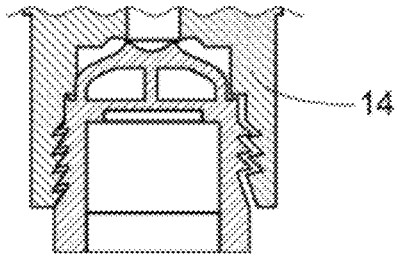
Figure 21:
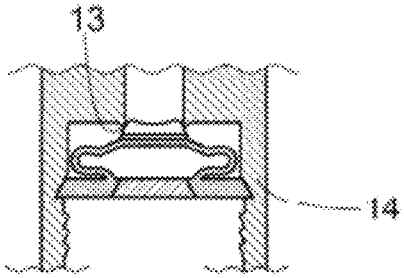
Figure 22:
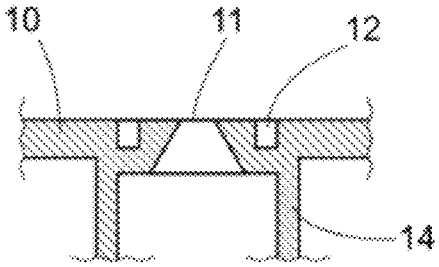
FIGS. 22, 23 are partial cross section views of different embodiments of the upper partition and bore formed therein.

An interesting form, already described with reference to FIGS. 1 and 2 and also shown in FIG. 20 is a valve member the body of which is prolonged in the form of a cylinder threaded to the interior of the cylindrical body 14, being fixed and centered. Its opening will be produced by deformation and not by the displacement of the whole body of the valve.

Figure 23:
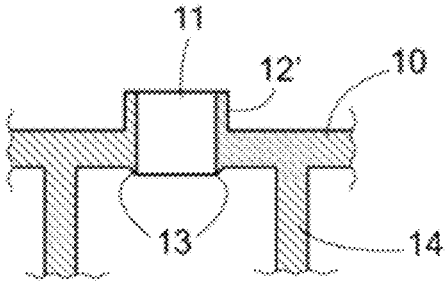

Mention to the closure members is completed with the arrangement shown in FIG. 23, where channel 12 has been replaced by a cylinder 12' which elevates around bore 11.

Operation

Functional relationship of the different components is very simple. It is the result of the integration of the three main parts of the head. A first operative removable part, i.e. interchangeable. A second plugging part with collapsible safety means. A third part including the valve means controlling dispensing of the fluid from container E.

Once container E is filled and properly plugged by means of the head fastened through thread 9 to the container neck, the safety seal comprised by skirt 27 is simultaneously mounted by means of the angular projections 28 which fit below the annular rib 36 provided around said neck.

The first part is located in the correct position by grooves 2 and 3 or variants thereof, rod 8 traversing bore and tubular prolongation 6 fits inside channel 12 provided as centering guide in the transversal partition 10 of the second component part of the head.

Channel 12 surrounding bore 11 allows optimum adaptation of the vertical outlet conduit 6 housing the actuator rod 8 operated by lever 7. Said actuator rod 8 faces concavity 19 of the valve means.

When using the siphon, this is done in the known manner, i.e. actuating lever 7 which descends the actuator rod 8 which pushes the valve head 19 against the elastic memory member added to the inner pressure. In this way, the head separates from the tapered seat 13 which allows dispensing liquid through the fishing tube 25 propelled by the pressure of the carbon anhydride gas contained in the beverage.

When lever 7 is released, valve means 17 returns to its normal closure position, being ready for the next use.

It is to be noted that the siphon head of the invention allows filling of container E even if previously plugged with such head, introducing the gasified liquid through bore 11 pressing the valve seat 13.

The invention not only affords an easy and economic way of manufacturing the closure cover, but it also affords a benefit in what concerns to hygiene of the product stored, which in this case does not depend on the conventional replaceable head.

The above description discloses some constructive alternatives for carrying out the invention and the operation thereof, the scope being only determined by the scope of the appended claims.

I claim:

1. A siphon head, providable in two separate mutually attachable parts, for dispensing a liquid from a pressurized container, said container having an interior storage space for containing a liquid and a threaded neck, said siphon head comprising (a) a cap assembly, comprising i) a generally cylindrical shell defining an interior cap space and having threads thereon positioned and sized in diameter and pitch to engage said threaded neck of said container to removably attach said cap assembly to said container;

ii) a siphon tube having a proximal end and a distal end, wherein the distal end of the siphon tube reaches into said interior storage space of said container when said cap assembly has been attached to said container, and said siphon tube has an interior passage therein operable to flow said liquid from said container in response to a pressure drop at the proximal end of said siphon tube;

iii) a valve disposed in said cap assembly, said valve being attached to the proximal end of said siphon tube so as to be in closed fluid communication with said interior passage of said siphon tube, said valve further providing an openable seal, said seal further being actuatable to open and thereby cause a pressure drop at the proximal end of said siphon tube in response to a force applied to said valve, said valve being biased in a normally closed position;

(b) an actuator assembly removably attached to said cap assembly, comprising i) a housing having a fitting for securely engaging an exterior fitting of said cap assembly to removably attach said housing to said cap assembly, and ii) a unitary actuating member movably attached to said housing, said actuating member comprising an ejector nozzle and a vertical tubular portion integrally formed with an actuating lever and an actuator rod, wherein said actuating member is configured to move between a first position, where said actuator rod is not in contact with said valve and said valve is closed, to a second position, where the actuating member engages said valve to exert a force on said valve to cause said valve to open, and wherein said ejector nozzle and actuating lever are integral with one another to move together relative to the siphon tube when the actuating member is moved from the first position to the second position, wherein the cap assembly further comprises a transversal partition having an axial bore surrounded by an annular channel and a bottom free end of the actuator rod is aligned with said bore and the open end of the vertical tubular portion is aligned with the annular channel in a manner that said bottom free end and said open end are spaced apart from the bore and channel, respectively, in the first position of the actuating member and in a manner that said bottom free end is passing through said bore and pushing over said valve and said open end is in sealing engagement to said channel, in the second position of the actuating member.

2. The siphon head of claim 1, further comprising a safety interlock comprising a breakable annular strip at a bottom edge of a cylindrical outer wall of said cylindrical shell and projecting retaining members to lock against a neck of said container.

3. The siphon head of claim 1, wherein said valve is provided with a seat in said shell, said seat being in the form of a rib forming a seal for the contents of said container.

4. The siphon head of claim 1, wherein said fitting of the housing and said exterior fitting of the cap assembly comprise corresponding engageable threads.

5. The siphon head of claim 1, wherein said interior of cap assembly further comprises a cylindrical boss with a cylindrical inner wall for receiving said valve, and wherein said valve is fittable into said cylindrical inner wall of said cap assembly.

6. The siphon head of claim 5, wherein said valve is a cylindrical resilient piece, said resilient piece further comprising an inner passage having grooves therein for retaining said siphon tube.

7. The siphon head of claim 6, wherein said valve is fitted into said cylindrical inner wall of said boss of said cap assembly by a threaded fitting, wherein the interior of said cylindrical wall and the exterior of said valve have corresponding engageable threads.

8. The siphon head of claim 6, wherein said valve is fitted into said cylindrical inner wall of said boss of said cap assembly by a diameter restriction in said cylindrical inner wall and the body of said resilient valve has a diameter retainable in said restriction.

9. The siphon head of claim 1, wherein said valve is comprised of a resilient material and wherein said openable seal comprises a frustoconical axial bore in said shell of said cap assembly and a corresponding frustoconical sealing head in said valve.

10. The siphon head of claim 1, wherein said valve is comprised of a resilient material and wherein said openable seal comprises a sealing head in said valve, and the body of said valve further comprises a plurality of resilient ribs joining said body and said sealing head and defining a passage for fluid through said valve.

11. The siphon head of claim 3, wherein said valve is comprised of a resilient material and a sealing head, and wherein said valve further comprises a sealing shoulder around said sealing head for sealing against a valve seat formed within said valve, to form a seal for preventing fluid escape from said container.

12. The siphon head of claim 1 wherein said siphon tube is a tube for filling an empty container onto which said cap assembly has been threadedly attached and sealed.

13. The siphon head of claim 12 further comprising a safety interlock comprising a breakable annular strip at a bottom edge of a cylindrical outer wall of said cylindrical shell and projecting retaining members to lock against said container neck.

14. The siphon head of claim 1, wherein the shell of said cap assembly further comprises an annular ring concentric with and interior to said threads in said shell for forming a fluid-tight seal with the inner upper circumference of said neck of said container.

* * * * *